US007086210B2

(12) United States Patent
Focke et al.

(10) Patent No.: US 7,086,210 B2
(45) Date of Patent: Aug. 8, 2006

(54) METHOD OF, AND APPARATUS FOR, PRODUCING (CIGARETTE) PACKS

(75) Inventors: Heinz Focke, deceased, late of Verden (DE); by Jürgen Focke, legal representative, Verden (DE); by Doris Focke, legal representative, Verden (DE); Heido Spöring, Verden (DE); Martin Stiller, Verden (DE)

(73) Assignee: Focke & Co. (GmbH & Co. KG), Verden (DE)

( * ) Notice: Subject to any disclaimer, the term of this patent is extended or adjusted under 35 U.S.C. 154(b) by 3 days.

(21) Appl. No.: 10/822,144

(22) Filed: Apr. 12, 2004

(65) Prior Publication Data

US 2004/0250513 A1 Dec. 16, 2004

(30) Foreign Application Priority Data

Apr. 17, 2003 (DE) ..... 103 18 055

(51) Int. Cl.
*B65B 61/20* (2006.01)

(52) U.S. Cl. ..... 53/415; 53/135.1; 53/136.1; 156/273.1

(58) Field of Classification Search ..... 53/415, 53/135.1, 135.2, 136.1; 29/900; 156/273.1
See application file for complete search history.

(56) References Cited

U.S. PATENT DOCUMENTS

| | | | | |
|---|---|---|---|---|
| 3,508,993 | A * | 4/1970 | Grothjan et al. | 156/215 |
| 4,182,222 | A * | 1/1980 | Stahl | 156/324 |
| 4,372,798 | A * | 2/1983 | Dalton | 156/273.1 |
| 4,432,187 | A * | 2/1984 | Elsner et al. | 53/135.2 |
| 4,757,667 | A | 7/1988 | Elsner | |
| 5,607,526 | A * | 3/1997 | Buckley | 156/64 |
| 6,105,340 | A * | 8/2000 | Draghetti | 53/415 |
| 6,138,437 | A * | 10/2000 | Focke et al. | 53/133.7 |
| 6,467,621 | B1 | 10/2002 | Ishida | |
| 6,684,606 | B1 * | 2/2004 | Draghetti | 53/415 |
| 6,808,593 | B1 * | 10/2004 | McCardell | 156/379.6 |
| 2002/0056258 | A1 | 5/2002 | Putzke et al. | |
| 2003/0010656 | A1 | 1/2003 | Focke et al. | |

FOREIGN PATENT DOCUMENTS

| | | |
|---|---|---|
| DE | 26 50 141 A1 | 8/1977 |
| DE | 32 39 378 C2 | 2/1989 |
| DE | 196 13 832 C2 | 12/1998 |
| DE | 198 41 526 A1 | 3/2000 |
| EP | 0 895 946 A1 | 2/1999 |
| FR | 2619356 A1 | 2/1989 |
| JP | 7 267217 | 10/1995 |

* cited by examiner

*Primary Examiner*—John Sipos
(74) *Attorney, Agent, or Firm*—Sughrue Mion, PLLC

(57) ABSTRACT

In order to produce (cigarette) packs with an insert blank (25) applied within the pack or to the outside of the latter, this insert blank is fixed temporarily by virtue of the pack or pack contents being electrostatically charged in the region of the insert blank (25). The pack is completed while the static charge is active, with the result that, by way of pack blanks, the insert coupon (25) is fixed in the envisaged position by the pack itself.

6 Claims, 5 Drawing Sheets

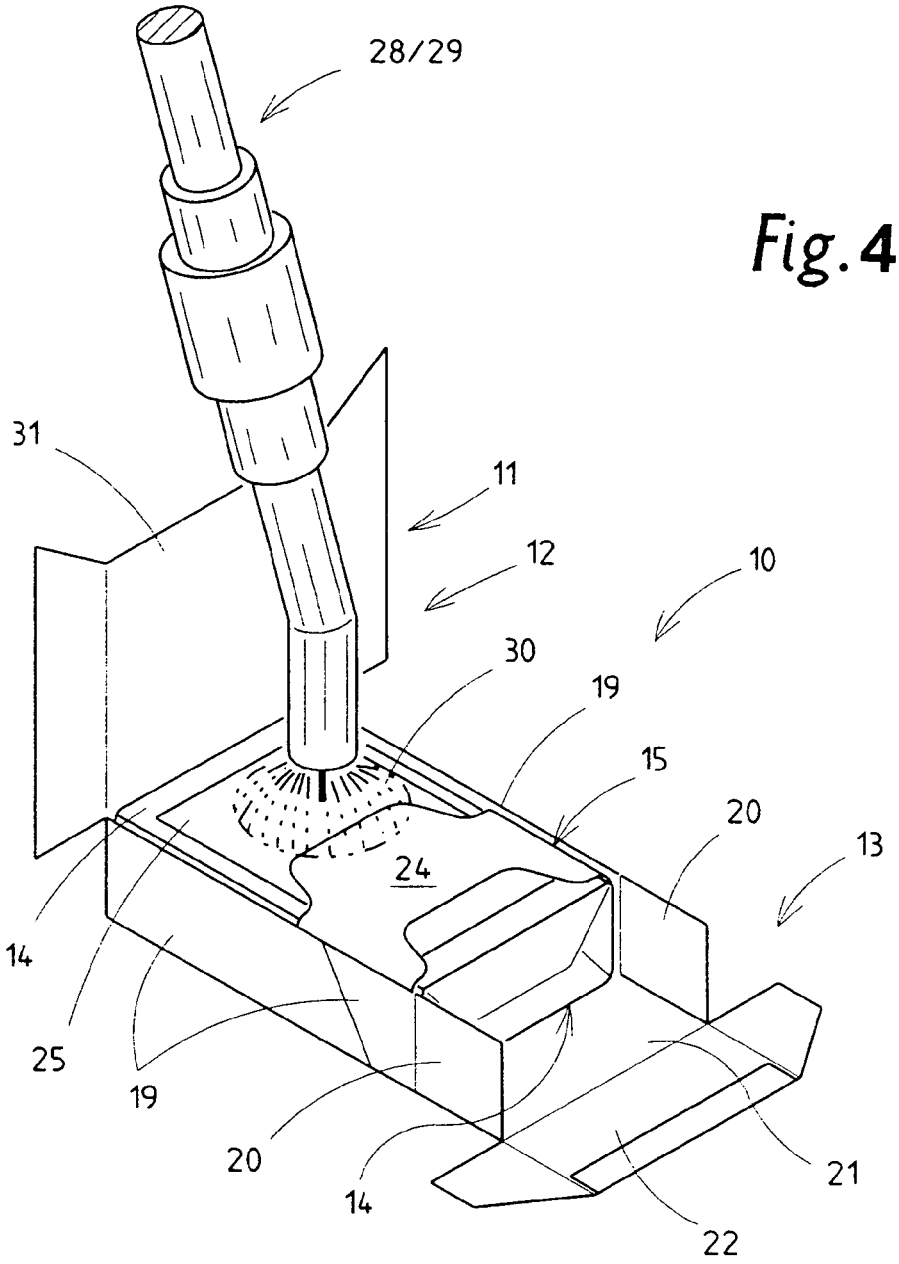
Fig. 4
Fig. 5
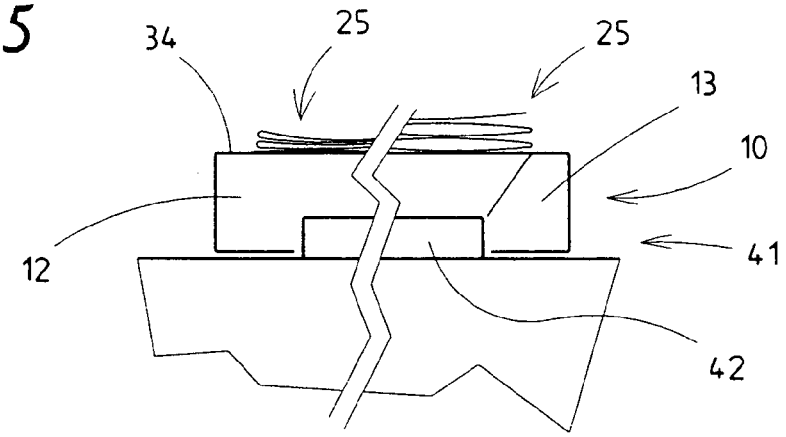

METHOD OF, AND APPARATUS FOR, PRODUCING (CIGARETTE) PACKS

BACKGROUND OF THE INVENTION

The invention relates to a method of producing packs, in particular cigarette packs, which have a separate blank made of thin material as a pack insert—insert blank—in particular a coupon, a revenue stamp or the like, the insert blank being arranged in or on the pack and being enclosed by at least one pack blank. The invention also relates to an apparatus for implementing the method.

It is increasingly common in the cigarette industry for the cigarette packs to have printing carriers, namely coupons, made of a separate blank added to them. The coupons contain information for the consumer, advertising, etc. One difficulty is to introduce the pack inserts into the packs during the packing process without the operating procedure being adversely affected. Different solutions are known for this purpose, e.g. arranging the coupon within the pack, on the pack contents (cigarette block), or on the outside of the pack (hinge-lid box, soft carton), with the result that the coupon is enclosed externally merely by the outer wrapper made of film, which is customary for cigarette packs.

SUMMARY OF THE INVENTION

The invention deals with the production of, in particular, cigarette packs with at least one insert blank which is enclosed by at least one pack blank. The object on which the invention is based is to ensure that the pack insert, which comprises a separate blank, is retained in a precise predetermined relative position during the production process for the packs.

In order to achieve this object, the method according to the invention is characterized in that the blank—insert blank—is fixed at least temporarily on the pack or on a sub-pack by electrostatic charging of the material.

The invention is based on the knowledge that the coupon, which is fed by a separate subassembly—coupon dispenser—and positioned on the (sub-)pack, is displaced on the pack during continued transportation, on account of accelerating and centrifugal forces, before the pack is engaged by the folding process continuing or by a further pack blank. The electrostatic charging of the pack or sub-pack results in the insert blank, which is already in position or is fed following the charging operation, being fixed in position in a stable manner. This electrostatic retaining force then automatically loses its effect. Up to that point, the packaging process has continued to the extent where the insert blank is retained in the desired position by the pack itself.

In the case of the apparatus according to the invention, an electrostatic charging means, in particular a charging electrode, is positioned in the region of a conveyor for the packs or sub-packs, namely above the movement path. This charging electrode is directed towards the pack, which is conveyed continuously or is at rest during the electrostatic charging. It is possible here, according to the invention, for the electrostatic charging to take place immediately before the insert blank is applied or once the blank has been positioned on the (sub-)pack.

BRIEF DESCRIPTION OF THE DRAWINGS

Further special features of the invention are explained in more detail hereinbelow with reference to the drawings, in which:

FIG. 4 shows a perspective illustration of a cigarette pack, namely a hinge-lid box, during production of the same, FIG. 5 shows a (cigarette) pack in side view with the insert blank placed in position (transverse view V—V in FIG. 8)

DETAILED DESCRIPTION OF THE INVENTION

Figure 1:
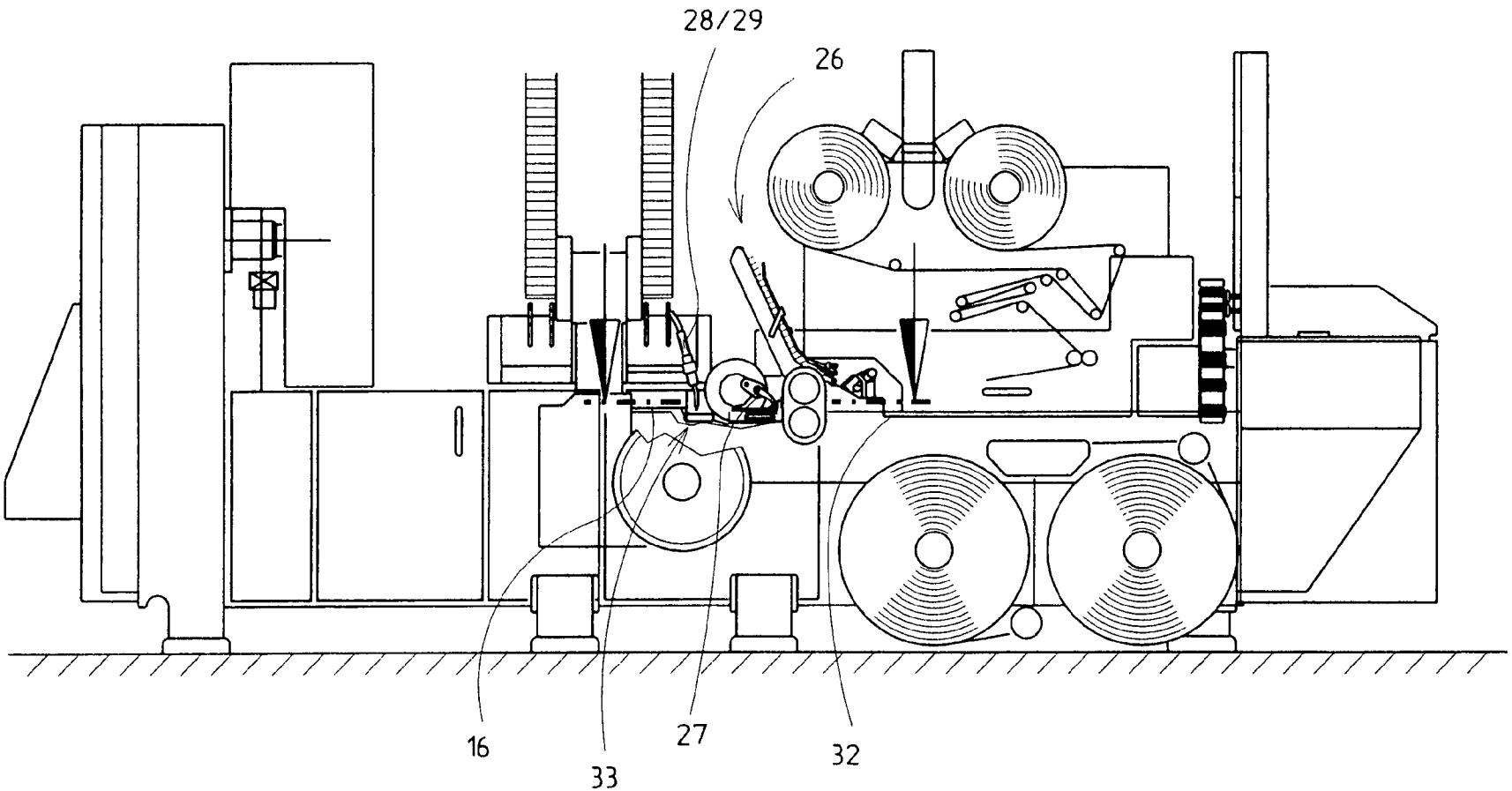
FIG. 1 shows a schematic side view of a packaging machine for producing cigarette packs.

The invention is concerned with the production of packs 10, in particular cigarette packs. A pack 10 of the hinge-lid-box type is shown as a preferred example (FIG. 4). This pack comprises a pack blank 11 made of thin cardboard, which forms a box part 12 and a lid 13. The pack contents are formed by a group of cigarettes wrapped in an inner blank made of paper, film or tin foil, with a cigarette block 14 being formed in the process. This type of pack also contains a collar 15 comprising a separate blank.

Figure 2:
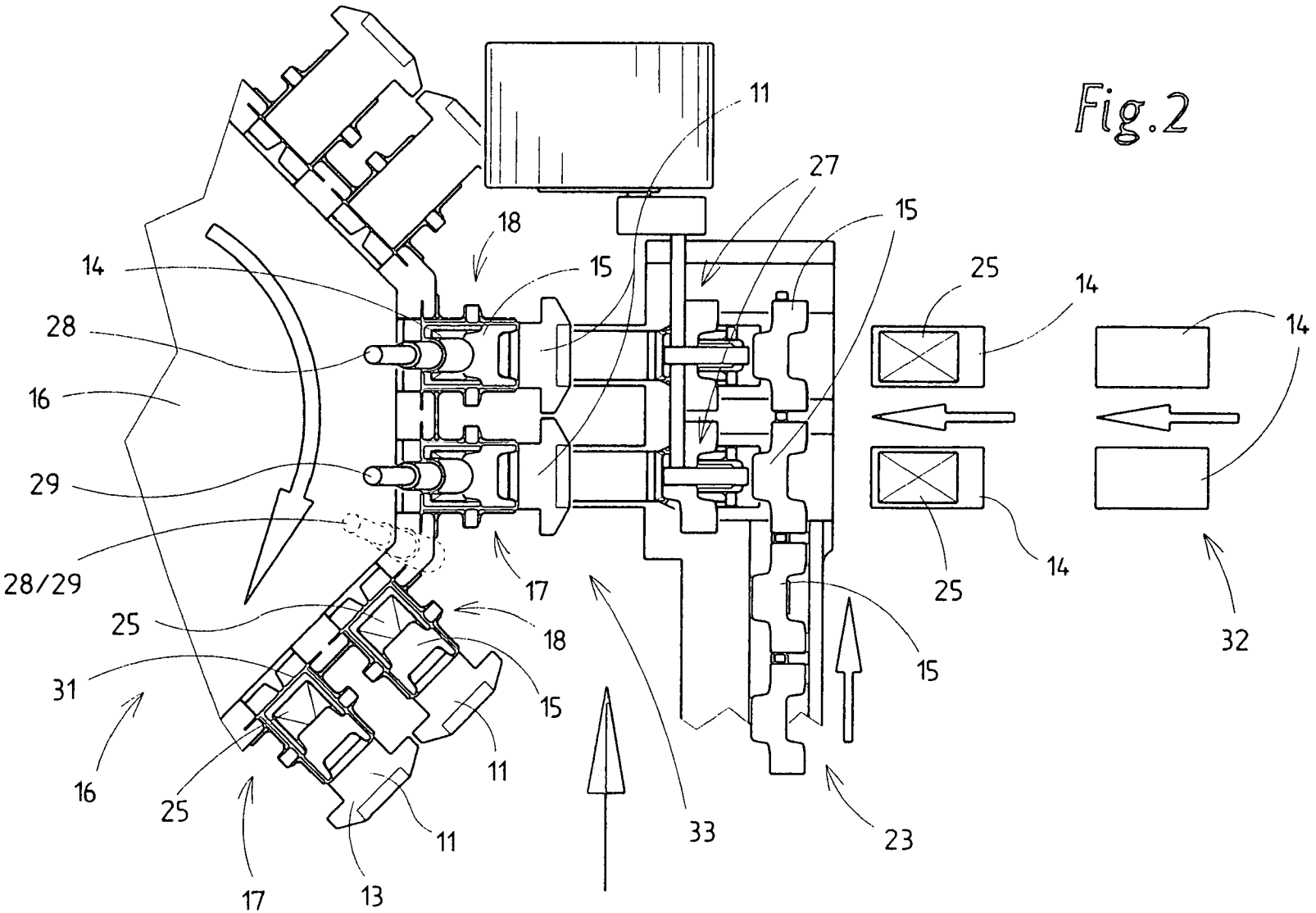
FIG. 2 shows, on an enlarged scale, a detail of the packaging machine according to FIG. 1 in a plan view corresponding to view plane II—II in FIG. 1.
Figure 3:
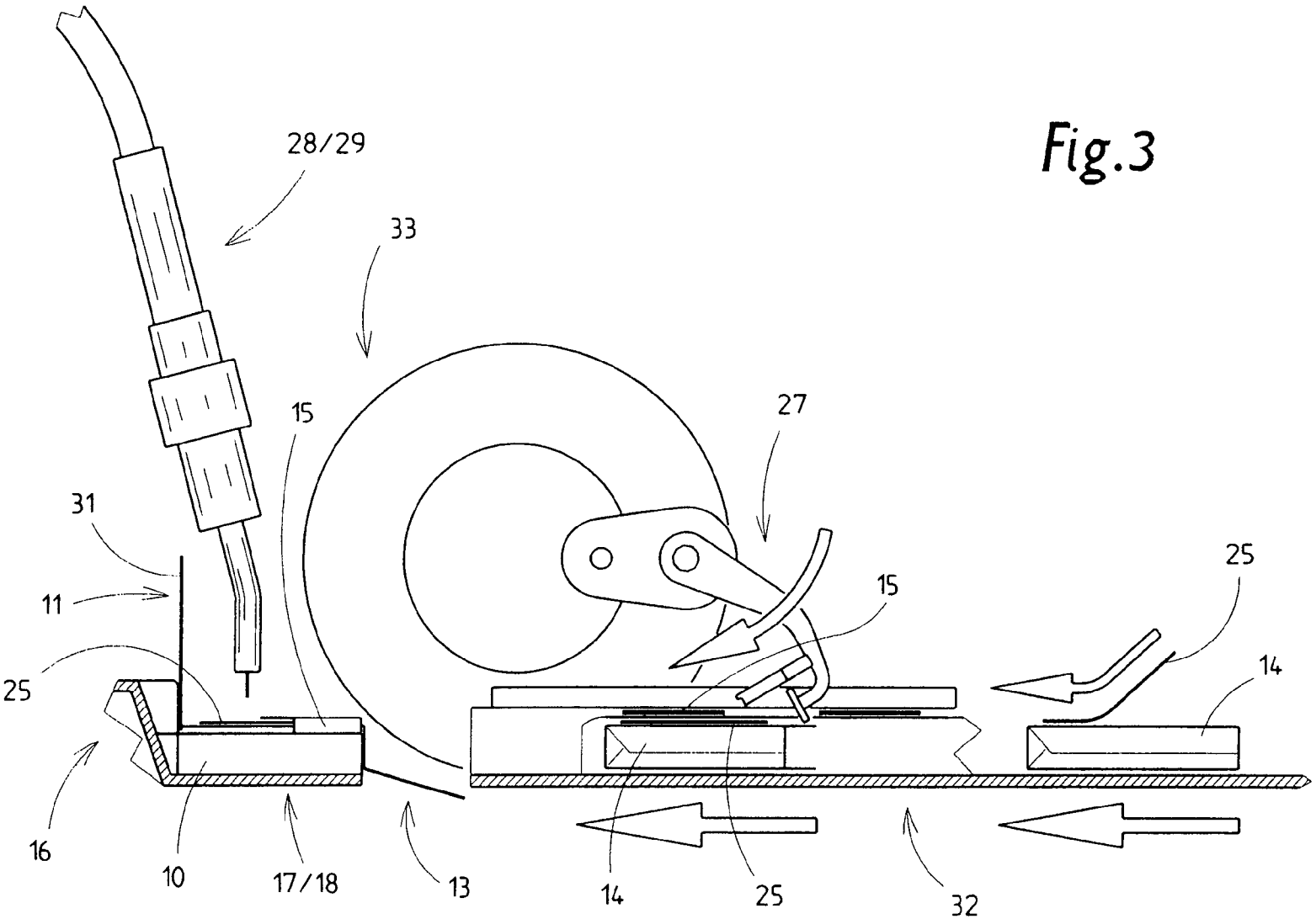
FIG. 3 shows, on a further-enlarged scale, a detail of FIG. 2 in a side view corresponding to arrow III from FIG. 2.

For the production and filling of a pack 10 of the above-mentioned type in a packaging machine according to FIG. 1, the pack blanks 11 are fed one after the other to a folding turret 16. In the case of the present exemplary embodiment, the folding turret 16 is of plate-like design and is driven in rotation (cyclically) about a vertical axis. The packaging machine according to FIGS. 1 and 2 is set up for double-track operation. In each case two adjacent pockets 17, 18 of the folding turret 16 are simultaneously charged with a pack blank 11. The latter is folded on a preliminary basis here to achieve a folding position, with upright side tabs 19 and corner tabs 20 within the pockets 17, 18, which is L-shaped or angled in longitudinal section (FIG. 4). A base wall and following lid base wall and lid end wall 21 and lid front wall 22 extend in the plane of the rear walls or in the plane of base walls of the pockets 17, 18. A radially inner upright leg of the pack blank 11 comprises a base wall and a following box front wall 31.

In the folding position according to FIG. 4, the pack blanks 11 in the pockets 17, 18 are held ready in order to receive in each case one cigarette block 14 (FIG. 2). The cigarette blocks, which are produced elsewhere, are transported to the folding turret 16 on a block path 32, which runs radially in relation to the folding turret, and are pushed into the partially folded pack blanks 11 in the pockets 17,18 (position according to FIG. 4).

Before the cigarette block 14 is pushed into an associated pack blank 11, a collar 15 which has been folded in a U-shaped manner is positioned on the top side of the cigarette block 14. The non-folded blanks for the collar 15 are fed to the cigarette blocks 14 on a collar path 23, in a direction transverse to the block path 32, and, with u-shaped folding, are deposited on a cigarette block 14 in each case such that a collar front wall 24 butts against the large-surface-area top side of the cigarette block 14.

The packs 10 receive an insert, to be precise a printing carrier in the form of a separate insert blank 25 made of paper or of some other thin material. Each pack 10 receives such an insert blank 25. In the case of the exemplary embodiment according to FIG. 4, this insert blank is positioned within the pack 10, namely within the hinge-lid box, to be precise with abutment against the cigarette block 14 and beneath the collar front wall 24. The dimensions of the insert blank 25 cause the latter to extend over most of the region of an upwardly directed large-surface-area side of the cigarette block 14 (FIG. 4).

The operations of feeding the insert blank 25 and introducing the same into the pack 10 are integrated in the production process. In the present case, the insert blank 25 is positioned on the top side of the cigarette block 14 as the latter is transported along the block path 32. For this purpose, a feeding subassembly, namely a coupon dispenser 26, is arranged in the packaging machine (FIG. 1), above each block path 32. This coupon dispenser feeds the insert blanks 25 one after the other from above and positions them on each pack 10 or on each cigarette block 14. In the production of a hinge-lid box, the collar 15 is then positioned on the cigarette block 14 or on the insert blank 25. The unit which has been formed in this way is pushed into the pockets 17, 18, or into the partially folded blanks 11, by a pushing-in mechanism 27 in the region of a pushing-in station 33.

The insert blanks 25, which rest loosely on the packs 10 or the cigarette blocks 14, may be displaced by forces which arise during transportation of the packs 10 or cigarette blocks 14, in particular if a folding turret 16 is accelerated from a standstill. In order to fix the insert blanks 25 on the pack 10 or on the cigarette block 14, an electrostatic charge is generated. This causes the insert blank 25 to adhere to the pack 10 or to the cigarette block 14 over its entire surface area.

The electrostatic charging can take place as early as in the region of the conveying section, that is to say in the region of the block path 32. In the case of the exemplary embodiment shown, means for electrostatically charging the pack 10 or the cigarette block 14 and the insert blank 25 are positioned on the folding turret 16, namely above the pockets 17, 18 in the pushing-in station 33. These means are charging electrodes 28, 29 for each pocket 17, 18.

The charging electrodes 28, 29 are positioned (in a stationary manner) above the packs 10 such that an approximately conical electric field 30 is transmitted to the packs 10 or the cigarette block 14. The electric field 30 covers, in particular, an exposed region of the insert blank 25 beneath and/or alongside the collar 15. However, the electric field 30 may be such that the collar 15, in the correct position for the pack, is also covered by the electrostatic charging. Furthermore, the charging electrodes 28, 29 may be controlled such that an electrostatic field 30 is generated even as the cigarette block 14 is being pushed into the associated pack blank 11. The charge acts such that the insert blank 25 butts against the upwardly directed side or wall of the cigarette block 14 over its entire surface area. The retaining effect lasts for a limited period of time, at least until the insert blank 25 is fixed definitively within the pack, in particular by virtue of parts of the blank being folded over, in this case by virtue of the initially upright box front wall 31 being folded over against the top side of the cigarette block 14.

As an alternative, or in addition, it is possible for the charging electrodes 28, 29 or a single charging electrode to be positioned outside the region of the pushing-in station 33, in the movement path of the packs 10 or of the insert blanks 25, above the folding turret 16 (dashed illustration in FIG. 2). In this case, the pockets 17, 18 with their contents, that is to say pack blanks 11, cigarette block 14, collar 15 and insert blank 25, are moved past the stationary charging electrode and electrostatically charged one after the other. The power of the charging electrodes 28, 29 is expediently adjustable, to be precise up to a voltage of 30 KV (continuous voltage). The machine is earthed.

The effect of the electrostatic charge, surprisingly, allows optimum temporary fixing of multi-layered insert blanks 25. FIG. 5 shows a strip-like insert blank 25 folded in zigzag form, that is to say a multi-layered blank. The right-hand half of the illustration of the pack shows the insert blank 25 in a position in which it has not been subjected to electrostatic action, in which case the layers, on account of the material stressing not having been eliminated, are spaced apart from one another. The left-hand half of the figure shows that the electrostatic charging presses the plurality of layers against one another in a manner similar to a suction effect, with the result that the insert blank 25, which has been folded a number of times, attains a flat formation which is desirable for the packaging process.

Figure 6:
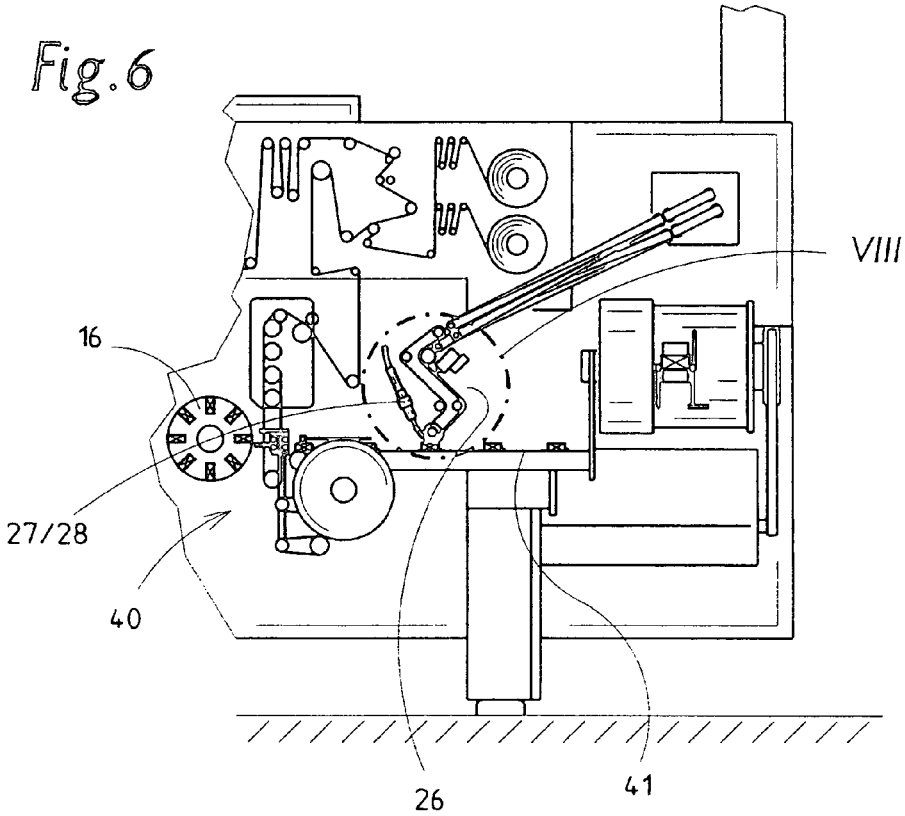
FIG. 6 shows a schematic side view of a detail of another embodiment of a packaging machine.
Figure 7:
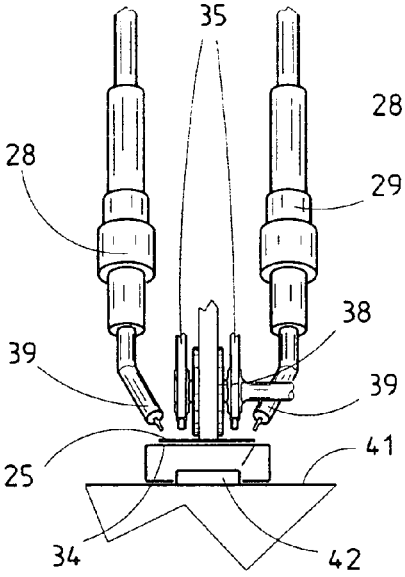
FIG. 7 shows, on an enlarged scale, a transverse view of part of the apparatus according to FIG. 6.
Figure 8:
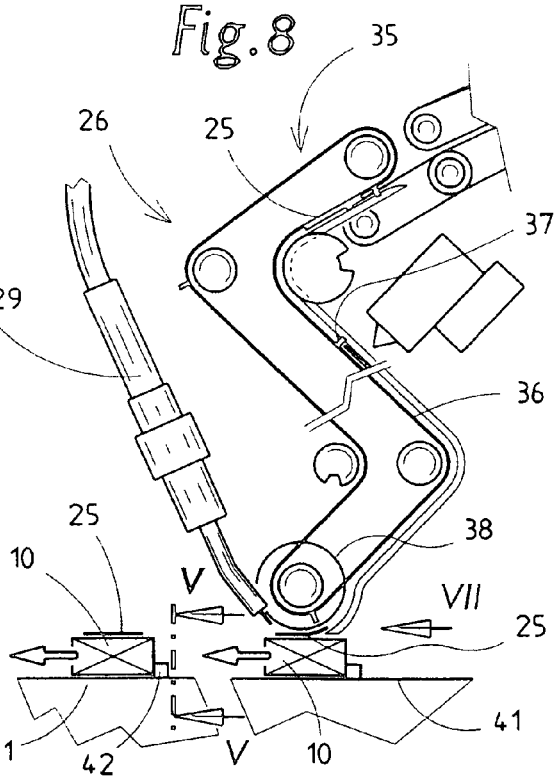
FIG. 8 shows, on an enlarged scale, a further detail, namely detail XIII of FIG. 6.

The fixing of an insert blank 25 may be desirable or advantageous during rectilinear conveying. FIGS. 6 to 8 show a solution, by way of example, in which the insert blank 25 is positioned on the outside of a finished pack 10, the latter being a cigarette pack of the hinge-lid-box type, with a box part 12 and lid 13. The insert blank is positioned on an upwardly directed rear side or rear wall 34 of the hinge-lid box.

In order to transfer the insert blanks 25 to the upwardly directed side of the packs 10, use is made of a specifically designed coupon dispenser 26, which essentially comprises a belt conveyor 35 which has been angled a number of times. The insert blanks 25 are transported at regular intervals from one another by a conveying strand 36, which has carry-along means 37 for each insert blank 25. A transfer means, to be precise a transfer wheel 38, is arranged in the region of a bottom leg of the coupon dispenser 26. This transfer wheel is positioned in the center between individual belts of the belt conveyor 35 and effects a rolling movement on the top side of the pack 10 while, at the same time, transferring the insert blank 25.

For electrostatic charging purposes, a means for generating an electrostatic field is arranged in the region where the insert blank 25 is transferred to the pack 10. This means is formed by two charging electrodes 28, 29, which are positioned on both sides of the belt conveyor 35 and of the transfer wheel 38. End pieces 39 of the charging electrodes 28, 29 are angled towards one another, with the result that, in the region of the packs 10, an electric field can be directed specifically towards border and/or end regions of the insert blanks 25. This ensures that at least (top and bottom) sub-regions of the insert blank 25 are fixed by electrostatic charging.

The pack 10 provided with the electrostatically fixed insert blank 25, following the coupon dispenser 26, passes, by continued transportation, into the region of a wrapping station 40. In the region of the latter, an outer wrapper made of film is folded around the pack 10 in a known manner, to be precise with the insert blank 25 being included in the process. In a first folding step, the pack 10, which is conveyed in a state in which it lies transversely, is enclosed in a U-shaped manner by a blank of the outer wrapper. By virtue of the pack 10 and blank of the outer wrapper being pushed into a pocket of a folding turret, the insert blank 25 is fixed mechanically at the same time. In this example, the electrostatic charging takes place as the packs 10 are transported continuously along a pack path 41 by carry-along means 42.

It is also possible for packaging machines or apparatuses for transporting packs 10 with an insert blank 25 placed in position to have a plurality of charging electrodes provided in different positions in order, repeatedly during the production process of a pack, to fix blanks on this pack or to renew a decreasing effect of the electrostatic charge.

The invention claimed is:

1. A method of producing packs (10) which have a separate insert blank (25), made of thin material, arranged in each pack (10) and enclosed by at least one pack blank (11), said method comprising the steps of:

a) first, placing the insert blank (25) onto the pack (10, 14) at a location corresponding to a final position of the insert blank, b) then, electrostatically charging a unit, made up of the pack (10, 14) and the insert blank (25), by electrodes (28, 29), c) then, folding the pack blank (11) around the unit consisting of the pack (10, 14) and the insert blank (25).

2. The method according to claim 1, wherein the packs are cigarette packs of the hinge-lid type, said method further comprising the steps of:

a) in a region of the block conveyor (32), first applying the insert blank (25) to a top side of the cigarette block (14), b) then, placing a frame (15) on the unit, comprising cigarette block (14) and insert blank (25), such that the insert blank (25) is partially covered by the frame (15), and c) after a unit, comprising the cigarette block (14), the insert blank (25) and the frame (15), is inserted into the pocket (17, 18) of the folding turret (16), applying an electrostatic charge by the electrodes (28, 29) arranged above the cigarette block (14).

3. The method according to claim 1, wherein the insert blank (25) is formed in a number of layers folded in zigzag form, and is electrostatically charged such that the layers of the insert blank (25), as a result of the electrostatic charging, butt closely against one another and are fixed on the pack (10).

4. The method according to claim 1, wherein the insert blank (25) is elongated, and is electrostatically charged at two end regions thereof.

5. An apparatus for producing cigarette packs (10) each of which has a separate insert blank (25) made of thin material, the insert blank (25) being fed by a coupon dispenser (26) and positioned on a cigarette block (14) as the pack contents, said apparatus comprising:

a) a pack conveyor for transporting cigarette blocks (14) at a distance from one another along a block path (32), b) an insert blank (25) being placed by the coupon dispenser (26) on a top side of each cigarette block (14);

c) means for inserting the cigarette blocks (14), along with the insert blanks (25) lying on the top said of the blocks, into pockets (17, 18) of a folding turret (16) in a region of a push-in station; and d) at least one charging electrode (28, 29) disposed above the pockets (17, 18) of the folding turret (16), which are open at the top, in a region of the push-in station (33) for electrostatically charging a unit comprising a cigarette block (14) and an insert blank (25).

6. The apparatus according to claim 5, wherein, in the case of double-track operation, the folding turret (16) has two adjacent pockets (17, 18) in the region of the push-in station (33), a partially folded pack blank (11) being arranged in each pocket which accommodates one unit comprising a cigarette block (14), an insert blank (25) and a frame (15), said charging electrode (28, 29) being disposed above each pocket (17, 18) in the region of the push-in station (33).

* * * * *